United States Patent [19]

Beese

[11] 4,055,272

[45] Oct. 25, 1977

[54] CONTAINERS

[75] Inventor: Ronald E. Beese, Barrington, Ill.

[73] Assignee: American Can Company, Greenwich, Conn.

[21] Appl. No.: 702,344

[22] Filed: July 2, 1976

Related U.S. Application Data

[62] Division of Ser. No. 645,685, Dec. 31, 1975, Pat. No. 4,033,274.

[51] Int. Cl.[2] ..... B65D 25/14

[52] U.S. Cl. ..... 220/64; 113/120 A; 204/37 T

[58] Field of Search ..... 113/120 A; 220/64; 204/37 T

[56] References Cited

U.S. PATENT DOCUMENTS

| | | | |
|---|---|---|---|
| 668,834 | 2/1901 | Haaker et al. | 113/120 A |
| 2,086,166 | 7/1937 | Kronquest | 113/121 |
| 3,360,157 | 12/1967 | Bolt et al. | 113/120 |
| 3,934,527 | 1/1976 | Saunders | 220/64 |

*Primary Examiner*—G. L. Kaplan
*Attorney, Agent, or Firm*—Robert P. Auber; Ira S. Dorman; James B. Kinzer

[57] ABSTRACT

A seamless, closed bottom steel container (shell) principally for food products, is drawn and lengthened from a starting blank of steel having a layer of tin; afterwards, the shell is baked to develop a corrosion resistant tin-iron alloy between the steel substrate and a reserve layer of unalloyed tin.

4 Claims, 6 Drawing Figures

CONTAINERS

This is a division of application Ser. No. 645,685, filed Dec. 31, 1975, now U.S. Pat. No. 4,033,274.

BACKGROUND OF THE INVENTION

The ability of an electrolytic tin coating on the inside of an air-free steel shell to prevent corrosion due to the influence of food products contained therein has been known for many years, since 1937: See "Corrosion Resistance of Electrolytic Tin Plate," Part 2 by Kamm, Willey, Beese and Krickl, *Corrosion,* February, 1961.

In a series of later studies (1963 to 1965) the advantageous influence of tin deposited electrolytically was identified with a layer of continuous close-packed tin-iron alloy crystals lodged between the steel substrate and the free tin surface. The alloy was determined to be the result of melting ("flow brightening") the tin coating, conventionally accomplished by heating the tin matte strip rapidly from room temperature to above the melting point of tin in four seconds or less followed by a water quench.

From these studies emerged the concept of "K plate" specifications related to factors of pickle lag, ISV and ATC. Pickle lag is a measure of the rate of pickling the low carbon steel base metal preparatory to plating; ISV (iron solution value) is a corrosion test to measure the quantity of iron exposed through an electrolytically deposited tin coating on a low carbon steel substrate; and ATC (alloy tin couple) is a corrosion test to measure the rate of tin dissolution from the surface of an electrolytically deposited tin coating on a low carbon steel substrate exposed to mildly acid food products typified by grapefruit juice.

Low values of ISV and ATC characterize high resistance to corrosion, necessary for K plate quality employed for those food products having mild to high acid values likely to produce catastrophic corrosion. Historically, the factors of K plate quality have been of immense value, particularly the ISV and ATC factors but for practical purposes of this invention the historic factors are supplanted by detinning measurements as a measure of K plate quality.

The paper entitled "K Plate for Heavily Coated Electrolytic Tin Plate Applications" (Kamm and Krickl, *Mechanical Working and Steel Processing,* IV, *Proceedings of the 8th Mechanical Working and Steel Processing Conference and Symposium on New Metal Forming Processes,* Metallurgical Society, AIME, 63-101, 1965; published by Gordon and Breach, N.Y., 1969) recognizes extremely low ATCs are obtained by baking the tin plate at temperatures below the melting point of tin and that such treatment would be useful in advancing inferior grades of tin plate "to the K plate level, were it not for the fact the alloy is not mended at pores in the tin coating." From this it was concluded that baking after melting was not the way for encouraging K plate quality. Indeed, the article then proceeded to emphasize that the factors for encouraging K plate quality, where it has not been achieved, would be in the realm of (a) preparation of the steel more readily receptive of tin plating, (b) pretreatments of the steel to remove oxide or contaminants from the steel surface, (c) pretreatments to promote alloy nucleation or, (d) melting techniques to overcome resistance to alloy nucleation. One aspect of nucleation will be discussed below. These conclusions were founded in part on data set forth in an earlier article entitled "Methods for Improving Corrosion Resistance of Electrolytic Tin Plate" (Kamm, Willey and Beese, *Materials Protection,* December, 1964.)

The 1964 and 1965 studies analyze in detail the solid phase alloy nucleation technique (SPAN Melting disclosed in Kamm U.S. Pat. No. 3,087,871) developed "from porosity studies which indicated that a matte tin deposit is more continuous than the same coating after melting." According to this technique, the close-packed continuous tin-iron alloy, deemed necessary for corrosion resistance, is sought to be achieved by heating the matte tin steel strip to a temperature of 420°-450° F (below the melting point of tin) in a very short time, held there for about 4 seconds, then heating to above the melting point of tin within a second, followed by the quench.

Regardless, the authors of the earlier article (1964) found variable results depending on the quality of the steel. This finding prevailed even though severe increases in both time and temperature were adopted and in spite of purposely inducing melting both before and after treatment according to the Kamm patent. More importantly, it was found that trying to control the temperature within the very narrow limits required, coupled with the high cost of induction heating equipment to obtain those narrow limits, were insurmountable production problems. The conclusion was that superior tinplate from the standpoint of corrosion resistance would be achieved "by improving steel processing prior to the tinning line." This was confirmed by the authors of the later study, Kamm and Krickl, 1965.

(Conventional melting of a matte tin surface on steel is shown by FIG. 1 hereof and SPAN melting is shown by FIG. 2, identified hereinafter.)

It should be understood that the studies referred to above, and the Kamm patent as well, are concerned with achieving K plate of the highest quality in order to safeguard the steel container against the corrosive influence of certain food products over a long period of time. Containers for packaging other food products do not necessarily require K plate quality.

The efforts discussed above to achieve K plate of exceptional integrity have been concerned with preparing matte tin steel plate for soldered forms of can containers characterized by three pieces, namely, a cylindrical body with a soldered side seam, a bottom and a top.

In the meantime, almost concurrently with those studies, commercial development of seamless steel containers materialized. A seamless container may be formed in two ways, principally. It may be achieved by draw-redraw or by draw-and-iron. In redrawing, a starting blank is first drawn to cup shape and then redrawn in successive steps progressively to lengthen the cylindrical side wall of the cup to develop a shell of the desired length. The metal for developing the side wall is obtained from the periphery of the blank and there is virtually no change in wall thickness compared to the starting blank. In draw-and-iron the starting blank is also initially drawn into a cup shape but progressive length is developed afterwards by a series of ironing dies (progressively of smaller diameter) which progressively thin the side wall to obtain metal for the lengthened shape, causing the side wall to become thinner and thinner in the course of developing a shell of the desired length. In both forms of production, the blank, flat to start with, is drawn to cup form and the circular side wall is progressively lengthened until a closed bottom shell of the desired length is obtained. A suitable shell of the seamless type may also be obtained by a mere draw in a single pass.

Until the derivation of the present invention, as best known, there has been no seamless, tubular, closed bottom food container which exhibits sufficient K plate quality to preserve contents of high acidity (e.g. tomato juice and grapefruit juice) for prolonged periods. The reason, simply stated, is that during drawing the tin-iron alloy is drawn (worked) and ruptured. Continuity of the alloy is demolished and iron is exposed to the acidity of the packaged food once the sacrificial tin layer has been exhausted in the critical areas.

THE PRESENT INVENTION

It has now been discovered by accident, and reflection on that accident, that the way to achieve greater continuity in the critical alloy layer in a seamless steel shell, constituting a container for food products, is not to form that layer before forming the shell in accordance with conventional practice, but to do it afterwards. Indeed, the present invention originated as the result of chance inspection of a draw-redraw steel shell having a thick, unmelted, unbaked matte tin surface. There was no appreciable discontinuity of the matte tin at any area, not even at the radius where the side wall meets the bottom.

Accordingly, one object of the present disclosure is to make available a method for producing seamless shell-type steel containers in which the desired, close-packed tin-iron crystals in a continuous layer are not only achieved but are achieved at an economic advantage and in a way not foreshadowed by any prior knowledge.

More specifically it is an object of the present invention to make possible a tin-iron alloy crystal continuum in a seamless steel container of the shell type merely by commencing with unalloyed matte tin steel, drawn and redrawn or drawn and ironed, and afterwards baking the shell at a temperature below the melting point to produce the continuum. The desired result is achieved by employing a blank of low carbon steel sheet material having an unalloyed matte tin surface of predetermined thickness, drawing the shell and afterwards baking the shell at the temperature and time required to alloy tin and iron. The predetermined thickness must be of such order as to assure a virtually complete, continuous surface of matte tin following formation of the shell, while leaving enough tin reserve both to form the alloy and to provide free tin for the sacrificial role as explained hereinafter in more detail.

Figure 3:
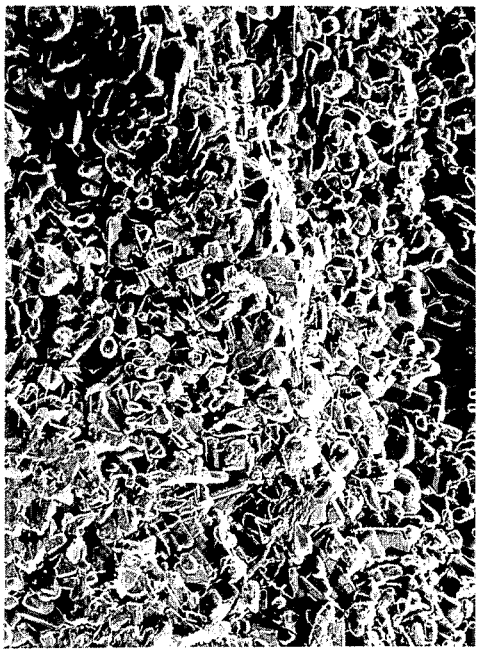
FIGS. 3 and 4 are photomicrographs (18500 x)
Figure 4:
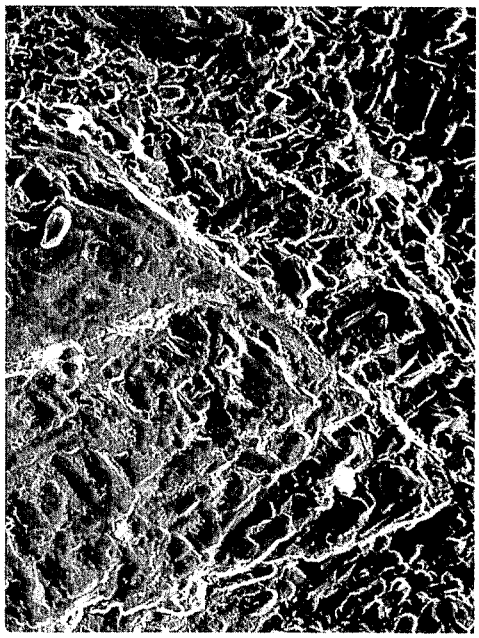
Figure 1:
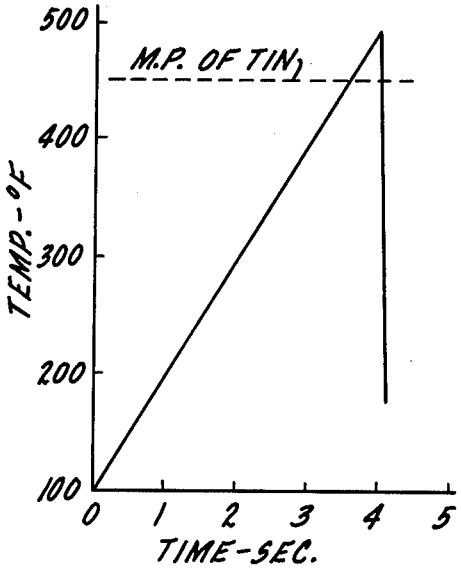
FIG. 1 is a diagram showing conventional melting values for a matte tin surface on steel plate.
Figure 2:
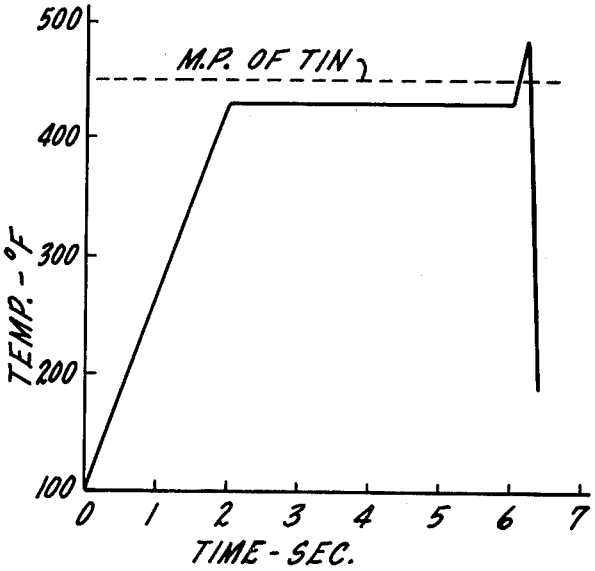
FIG. 2 is a diagram showing SPAN melting values for a matte tin surface on steel plate.

FIGS. 3 and 4 are photomicrographs showing a phenomenon encountered in the course of producing a drawn shell from a low carbon steel starting blank having a melted matte tin surface presenting a tin-iron alloy of K plate quality in accordance with conventional melting practice diagrammed in FIG. 1. After the draw, FIG. 3, the alloy crystals are broken and piled up, caused by differential movement between the steel substrate and the free tin overlay and by the formation of small ridges and valleys which the alloy simply cannot conform to. This loosened alloy can be easily rubbed off, FIG. 4, revealing underlying areas of exposed steel, explaining the inability of shells thus formed to withstand mildly acid food products (such as grapefruit juice or tomato juice) for long periods of time.

The solution to this problem of alloy rupture was inspired from a wholly unrelated phenomenon. Thus, examination of a drawn seamless shell having an original thick matte tin surface (no alloying) revealed no discontinuity in the tin surface in spite of severe working during the draw.

Reflection on the undisturbed matte continuity phenomenon of the drawn shell, observed by chance in a thick matte, suggested that if the matte surface was still thick enough to furnish adequate tin for alloying with the iron, while leaving enough tin for the sacrificial role as an anode, then subsequent baking of the shell ought to grow the alloy in the continuum deemed necessary for preserving the quality of certain food products over long periods of time. If successful, seamless shells could be produced having the integrity of the best three-piece soldered steel containers.

Figure 5:
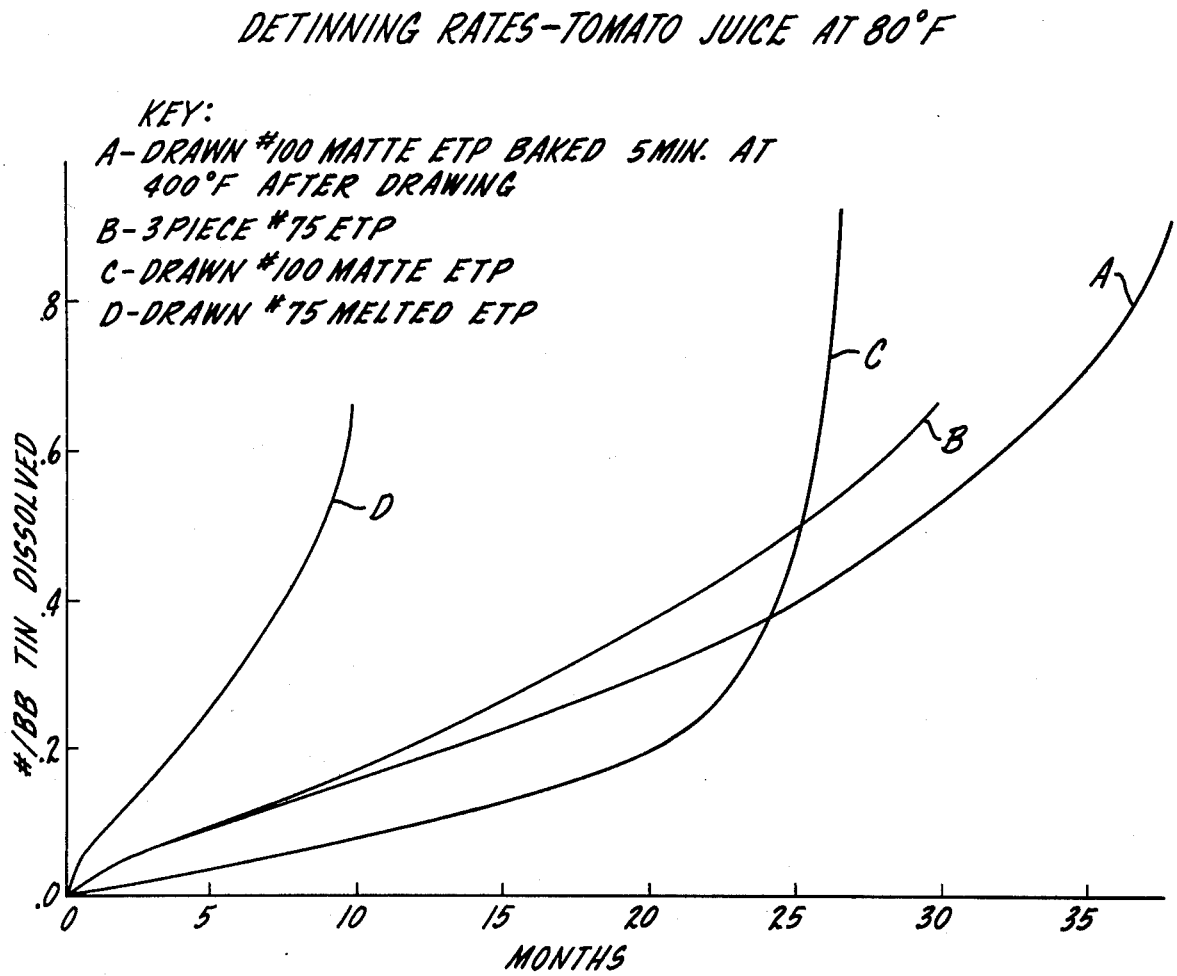
FIG. 5 is a diagram showing detinning rates for certain test materials.

FIG. 5 shows the practical result of pursuing this objective by baking for 5 minutes at 400° F a drawn shell of low carbon steel, having an original matte thickness of 60 micro inches. A drawn container, processed as just described, curve A, exhibited a detinning rate less than the three-piece container and far superior to the other two, explained in more detail below.

The preferred practice may vary, particularly from the standpoint of the contained food. For moderate acid contents such as tomato juice, the steel substrate may be grade MR steel plate but for high acid contents such as red sour pitted cherries the preference is grade L steel plate having the following nominal analyses:

TABLE 1

| Component | STEEL GRADES L Grade | MR Grade |
|---|---|---|
| C | 0.13 | 0.13 |
| Mn | 0.6 | 0.6 |
| P | 0.015 | 0.02 |
| S | 0.05 | 0.05 |
| Si | 0.01 | 0.01 |
| Cu | 0.06 | 0.2 |
| Ni | 0.04 | |
| Cr | 0.06 | |
| Mo | 0.05 | |

The matte tin surface is deposited electrolytically. Previously, an alkaline plating bath was common but today nearly all tin plating on low carbon steel plate is obtained from an acid plating bath, either stannous sulfate or stannous chloride. The surface, after plating, may be chemically treated in a dichromate bath and then treated with a lubricant. These treatments, if employed, have no effect on the process of the present invention.

The international standard for tin plate thickness is the so-called Welsh base box (BB) having a total surface area of 62,720 square inches; see *Metals Handbook*, Vol. 1, 8th Ed., page 1135). This standard is employed herein:

TABLE 2

| Designation No. | BB STANDARD Pounds of Tin Plate/BB | Nominal Tin Plate Thickness/BB (Micro Inches) |
|---|---|---|
| 100 | 1 | 60 |
| 75 | 0.75 | 45 |
| 50 | 0.50 | 30 |
| 25 | 0.25 | 15 |

Sometimes the plate thickness is purposely different on the two sides, accounting for such designations as 100/25.

In accordance with the present invention and based on previous experience with the tin-iron alloy crystals, the amount of alloy on the critical side (inside diameter) should not be less than about 0.03 pounds/BB with enough free tin to serve in the sacrificial role as an anode during the prolonged period of shelf life. It is of significance to note that this minimum weight is satisfactory only if there is substantially complete continuity both in the free tin and the alloy layers, for reasons explained below.

EXAMPLE 1

A steel substrate, preferably grade L or the equivalent, is conventionally electroplated in an acid bath to deposit thereon a substantially continuous matte tin surface of No. 100 designation, that is, one pound of free, unalloyed tin/BB, and is preferably lubricated on the free tin surface as an aid to drawing.

A suitable blank was obtained from the tin plate thus produced and drawn to develop a seamless shell of suitable dimension for testing.

The drawn shell was then baked for five minutes at a temperature of 400° F, below the melting point of tin. A test specimen revealed a substantially continuous free tin surface, a free tin weight of 0.89 pounds/BB and a substantially continuous, tight layer of interposed tin-iron alloy crystals weighing 0.03 pounds/BB.

The baked shell was filled with tomato juice and carefully tested under rigorous conditions for predicting shelf life at 80° F. The results of this test are shown in FIG. 5 in which the rate of tin dissolution is compared to three other samples of shells (same steel grade) tested the same way for predicted shelf life. The samples for the test had the attributes set forth in Table 3.

TABLE 3

| Sample (FIG. 5) | Alloy/BB (pounds) | Free Tin/BB (pounds) |
|---|---|---|
| A | 0.03 | 0.89 |
| B | 0.08 | 0.64 |
| C | 0.00 | 0.87 |
| D | 0.09 | 0.65 |

Sample B, FIG. 5, as noted was a 3-piece can (soldered side wall) having a conventional No. 75 melted tin surface, melted before being shaped to grow the alloy. It compared most favorably to the shell produced in accordance with the present invention.

Samples C and D were seamless containers drawn precisely like sample A. Sample C had a No. 100 matte tin surface but was not baked after drawing, so there was no tin-iron alloy next to the steel substrate.

Sample D had a No. 75 matte tin surface, melted before drawing to originate the desired alloy; the alloy layer ruptured during the draw in the manner explained in connection with FIGS. 3 and 4.

Note that the curves in FIG. 5 are concerned with the rate of tin dissolution. The rate of tin dissolution is proportional to the amount of iron exposed through any discontinuity in the tin-iron alloy and the tin layers.

Neither the free tin layer nor the alloy considered herein can be expected to be perfectly continuous. Indeed the imperfection helps explain the variations in the tin rate dissolution which has been long established and verified as a practical measure of alloy quality.

Figure 6:
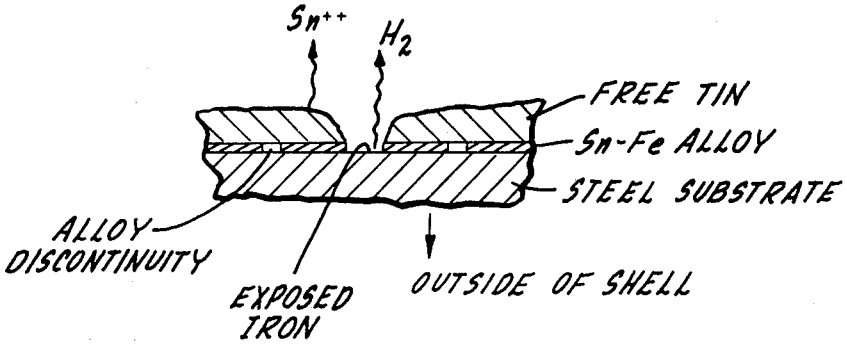
FIG. 6 is a diagram of phenomona occuring during detinning.

Any porous area in the free tin surface, FIG. 6, aligned with a discontinuity in the tin-iron alloy, exposes iron (steel substrate) to the acidity of the food product, resulting in two half cell reactions. Tin dissolves (the anode reaction is $Sn \rightarrow Sn^{++} + 2e$) and hydrogen is evolved at the iron surface resulting in the cathodic reaction which is $2H^{+} + 2e \rightarrow H_2$. As the tin dissolves exposing more alloy surface, more and more iron will be exposed proportional to the degree of imperfection in the alloy. The amount of current is proportional to the amount of iron exposed, accelerating the rate of tin dissolution. Only when the free tin is exhausted is the iron dissolved; hence, the sacrificial role of tin. The tin-iron alloy is itself nearly inert in the presence of mildly acid foods. When all protection is gone, the iron is attacked.

It will be seen then that the rate of tin dissolution is proportional to the amount of iron exposed as a result of discontinuity in the tin-iron alloy layer; or in other words, the rate of tin dissolution diminishes with increased perfection in the continuity of the alloy layer.

EXAMPLE 2

The alloy weight of 0.03 pounds/BB is very close to the minimum required for a food product having a mild acid value. To give more assurance against detinning, especially when applying the invention to the packaging of foods having high acid value, the alloy weight should be in the range of 0.06 – 0.08 pounds/BB which can be obtained by baking the shell of Example 1 at 400° F for 15 minutes. The rate of growth of the alloy appears to be a logarithmic function of the time at temperature but it may be mentioned the time-temperature baking practice depends a great deal on the method of heating. Thus, an alloy of good quality and acceptable weight under the present invention may be obtained in as short a time as 7.5 seconds at 438° F, for example.

The preferred matte tin weight, in any event, is one pound/BB (No. 100) for the more corrosive internal conditions; 0.50 pounds/BB is acceptable for less severe conditions, and the minimum is deemed to be 0.375 pounds/BB.

It is not necessary that tinplate be applied to the outside of the shell since the inner side is the critical surface, FIG. 6. However, it is customary to employ tinplate on the exterior to resist rust. While utility has been explained in terms of food content the invention may be applied to other seamless, tubular closed bottom containers where the packaged contents have a corrosive influence.

The term "drawn" (or "drawing") as used herein embraces a simple draw, draw-redraw and draw-and-iron. The term "matte" tin identifies electrolytically deposited tin which has not been baked to develop a tin-iron alloy before the draw. The amount of matte tin may range from the minimum height specified at least up to 1.5 pounds/BB. The weight of the alloy may range from the minimum weight specified up to at least 0.15 pounds/BB. The free tin surface may itself be covered if desired. Detinning rates were determined in accordance with the progressive ATC procedures given by Kamm and Willey at the First International Congress on Metallic Corrosion, London, April 1961; published by Butterworths, London.

I claim:

1. A drawn, seamless, closed bottom container of shell form drawn from a steel starting blank having an adherent layer of tin, characterized, at least on the inside, by an in-situ formed undrawn substantially continuous layer of tin-iron alloy next to the steel weighing at least 0.03 pounds per BB, and a substantially continuous layer of unalloyed tin next to the tin-iron alloy layer.

2. A container according to claim 1 in which the unalloyed tin is tin electroplate.

3. A container according to claim 1 in which the weight of tin-iron alloy is in the range of 0.03 to 0.15 pounds per BB.

4. A container according to claim 3 in which the unalloyed tin is tin electroplate.

* * * * *